US006902340B2

(12) United States Patent
Harris, Jr. et al.

(10) Patent No.: US 6,902,340 B2
(45) **Date of Patent: *Jun. 7, 2005**

(54) BINDER CONSTRUCTION FOR EASY INSERTION AND REMOVAL OF SPINE LABEL

(75) Inventors: Charles K. Harris, Jr., Meridian, MS (US); Jack B. Harrison, Little Rock, MS (US); Richard K. Joyner, Meridian, MS (US); Brian King, Brea, CA (US); Frank Ciotoli, East Longmeadow, MA (US)

(73) Assignee: Avery Dennison Corp., Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/681,725

(22) Filed: Oct. 8, 2003

(65) Prior Publication Data

US 2004/0197131 A1 Oct. 7, 2004

Related U.S. Application Data

(63) Continuation-in-part of application No. 10/406,069, filed on Apr. 2, 2003, now Pat. No. 6,761,498.

(51) Int. Cl.[7] ..... B42F 13/00

(52) U.S. Cl. ..... 402/73; 281/15.1; 402/80 R; D19/26

(58) Field of Search ..... 402/73, 80 R, 402/502; 281/15.1, 36; D19/26, 27, 33

(56) References Cited

U.S. PATENT DOCUMENTS

| | | | |
|---|---|---|---|
| 743,831 | A | 11/1903 | Cota |
| 1,431,714 | A | 10/1922 | Wilking |
| 1,677,277 | A | 7/1928 | Federbush et al. |
| 1,805,314 | A | 5/1931 | Morton |
| 1,865,741 | A | 7/1932 | Carney |
| 1,965,679 | A | 7/1934 | Welliver et al. |
| 2,051,907 | A | 8/1936 | Schade |
| 2,150,474 | A | 3/1939 | Williams |
| 2,304,980 | A | 12/1942 | Williams et al. |
| 2,509,841 | A | 5/1950 | Rose |
| 2,544,566 | A | 3/1951 | Rose |
| 2,852,275 | A | 9/1958 | Brook |
| 2,977,698 | A | 4/1961 | Chamberlin |
| 3,039,472 | A | 6/1962 | Duncan |
| 3,066,680 | A | 12/1962 | Duncan |
| 3,111,949 | A | 11/1963 | Duncan et al. |
| 3,133,750 | A | 5/1964 | Gerald |
| 3,195,924 | A | 7/1965 | Carter et al. |
| 3,262,454 | A | 7/1966 | Shillinger |
| 3,335,508 | A | 8/1967 | Hummel |
| 3,335,510 | A | 8/1967 | Littler |
| 3,663,041 | A | 5/1972 | White |
| 3,807,883 | A | 4/1974 | Karlsson |
| 4,190,374 | A | 2/1980 | Lindell |

(Continued)

*Primary Examiner*—Monica S. Carter
(74) *Attorney, Agent, or Firm*—Joel D. Voelzke

(57) ABSTRACT

In a binder such as a window binder having two opaque thermoplastic sheets sandwiching therebetween front and rear panels, a spine panel, and an outer clear panel forming a window over the spine panel and the front and rear panels, the spine has a depression or slot for receiving a spine label without substantial friction that would inhibit the insertion and removal of the spine label. The spine panel may either be sandwiched between the two opaque sheets, or it may be disposed on the outside of both of the opaque sheets, and the slot may be either open or closed at the side that faces the label printing. When disposed on the outside of the opaque sheets, the spine panel may be colored to provide a colored spine for an otherwise white or differently colored window binder.

20 Claims, 4 Drawing Sheets

U.S. PATENT DOCUMENTS

| | | | | |
|---|---|---|---|---|
| 4,219,951 | A | 9/1980 | Schmidt | |
| 4,294,469 | A | 10/1981 | Errichiello | |
| 4,315,642 | A | 2/1982 | Errichiello | |
| 4,600,346 | A | 7/1986 | Podosek | |
| D285,313 | S | 8/1986 | Maune | |
| 4,795,194 | A | 1/1989 | Etheredge | |
| 4,931,346 | A | 6/1990 | Nogueras Dardina | |
| 4,998,840 | A | 3/1991 | Ruble | |
| 5,030,027 | A | 7/1991 | Bacharach et al. | |
| 5,163,768 | A | 11/1992 | Salisbury et al. | |
| 5,330,279 | A | 7/1994 | Ruble | |
| 5,368,333 | A | 11/1994 | Arroyo | |
| 5,711,627 | A | 1/1998 | Chapman | |
| 5,720,564 | A | 2/1998 | Winzen | |
| 5,785,445 | A | 7/1998 | Podosek et al. | |
| 6,019,540 | A | 2/2000 | Senior | |
| 6,076,989 | A | 6/2000 | Pearce et al. | |
| 6,109,812 | A | 8/2000 | Welch | |
| 6,267,412 | B1 | 7/2001 | Henderson | |
| 6,290,421 | B1 | 9/2001 | Welch | |
| 6,761,498 | B1 * | 7/2004 | Harris et al. | 402/73 |
| 2003/0006603 | A1 | 1/2003 | Pontecorvo | |

* cited by examiner

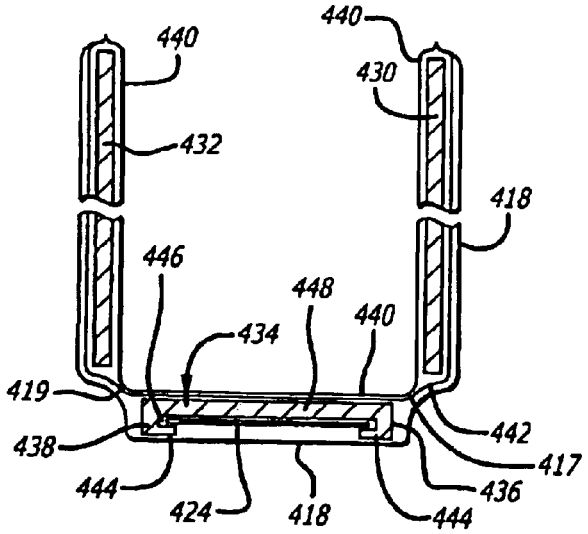
FIG. 14
FIG. 15
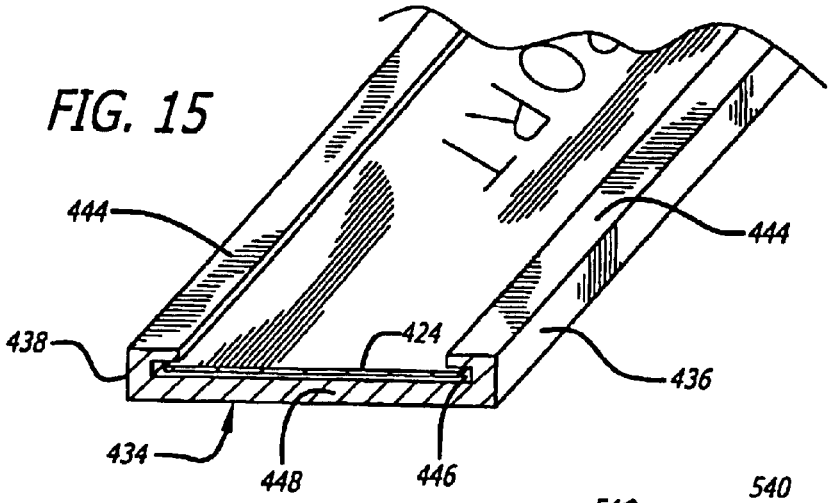
FIG. 16
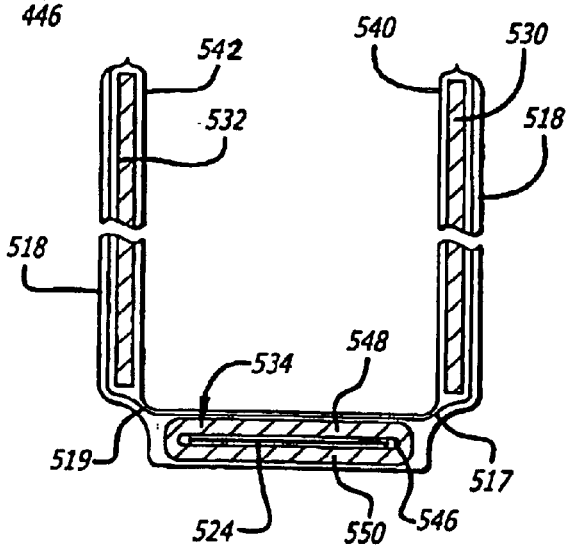

BINDER CONSTRUCTION FOR EASY INSERTION AND REMOVAL OF SPINE LABEL

RELATED APPLICATIONS

This application is a continuation-in-part of U.S. application Ser. No. 10/406,069 filed on Apr. 2, 2003 now U.S. Pat. No. 6,761,498.

FIELD OF THE INVENTION

The present invention relates to binders used in offices and other environments. More particularly, the present invention relates to a construction of a binder such as a ring binder in which the spine label has been modified to allow easy insertion of a spine label.

BACKGROUND OF THE INVENTION

Binders, such as ring binders, are commonly fabricated in a three-ply construction. In this construction, three rigid or semi-rigid rectangular inserts or stiffener panels are heat-sealed between two sheets of cover material. Of the three stiffener panels generally used, two of them approximate in size the back and front panels of the binder. The third panel is a narrower insert strip disposed between the two larger panels to form the spine panel of the binder. The inner and outer plastic sheets are fused together or heat-sealed around their peripheral edges. The sheets are also sealed transversely between the adjacent, transverse edges of the cover panel inserts and the spine panel inserts. The transverse seals form the hinge areas of the binder. U.S. Pat. No. 3,195,924 is typical of this type of binder construction.

The stiffener panels are typically made of relatively thick, relatively rigid material, such as cardboard, fiberboard or corrugated paper, which is commonly referred to as chipboard. The chipboard may be made of solid chipboard material or may be of a laminate construction such as disclosed in U.S. Pat. No. 4,931,346. The inner cover and the outer cover may be made of a thin sheet of any fabric, paper or plastic material, but most commonly are made of a thermoplastic material, such as polyvinyl chloride (PVC) or polypropylene, that is readily joined at the edges of the inner and outer covers along the periphery of the substrate by heat welding, or by electronic welding, such as ultrasonic or radio frequency (RF) welding. The above type of ring binder—frequently referred to in the art as a "plastic binder"—is typically made as follows: First, a pair of matching sheets of opaque thermoplastic material, typically PVC, are positioned on opposite sides of one or more stiffening members arranged to define a front cover panel, a spine panel and a rear cover panel. Next, the sheets are welded together, typically by RF welding, around their respective peripheries. In addition, the sheets are also typically RF welded together along a pair of hinge lines on opposite sides of the spine panel. Finally, a paper-retaining ring mechanism, typically a 3-ring mechanism that either snaps open and closed via a spring loaded mechanism, or which opens and closes via a locking mechanism, is attached to either the spine or to one of the covers. Looseleaf ring binder covers in accordance with the above description are shown for example in U.S. Pat. Nos. 4,600,346 and 5,785,445, which are hereby incorporated by reference for their teachings of binder construction.

The binder can also have a clear or transparent cover such as a plastic cover over the outside to hold and protect front and/or rear cover labels and a spine label. In this construction, the clear sheet covers most of the outside of the binder. The clear sheet is sealed to the opaque PVC sheets at its vertical edges and its bottom edge, and is sealed to the hinges, typically by the same sealing technique as is used to seal the opaque sheets together, and typically at the same time. The space between the clear sheet and the opaque PVC sheets thus forms typically three pockets: a front pocket at the front of the binder, a rear pocket at the rear of the binder, and a spine pocket at the spine of the binder. A full size sheet of printed paper such as a report cover can be inserted into the front pocket; a spine-sized piece of paper can be inserted into the spine pocket for labeling the spine; and a full size sheet of printed paper or back cover can be inserted into the rear pocket, thus giving the binder a professional appearance and allowing the user to quickly determine the contents of the binder whether the binder is laying flat and closed on a desk or is placed upright on a bookshelf with only the spine and its label facing outward. Binders of this construction are sometimes called window binders or view binders. An example of such a view binder is shown in FIGS. 1 and 2.

It can be difficult to label the spines of view binders. The clear or transparent overlay underneath which the user is expected to slide a spine label typically clings somewhat tightly to the binder spine making insertion of the label difficult, especially insertion of a label made of lightweight paper stock. For such spine labels, users sometimes resort to opening the binder and laying it flat on a surface such as a table in order to relieve sufficient pressure at the clear cover over the spine in order to allow insertion of the spine label into the spine window. Laying the binder flat is particularly inconvenient when the binder is full. Also, removing the label from the spine window in order to re-label the binder spine can be difficult because of the tight fit of the label into the spine window and the friction created thereby. Thus, there is a need for an improved binder that addresses one or more of the above drawbacks. The present invention satisfies this need.

SUMMARY OF THE INVENTION

The present invention provides a binder with an easily insertable and removable spine label. By creating a relief or void in the binder's spine board the friction is reduced, thus allowing for an easier insertion of the paper or card stock insert.

The invention relates to an improved binder which has a depression in the spine so that the spine label can be more easily inserted into a spine window. The depression in the spine allows the opaque flexible sheet covering the spine to depress inwardly, thereby giving additional room for the spine label and decreasing the resistance to movement of the spine label within the spine window.

In one embodiment, the spine panel is a generally flat sheet but has raised rails along the lengthwise edges of the spine panel. In another embodiment, the spine panel has raised rails along three or all four sides. In yet another embodiment, the spine is stamped so as to create raised rails or creases near the lengthwise edges. In yet further embodiments, the spine panel has a curved or angled cross-section. In one aspect therefore, the invention is of a binder having a spine construction for easy insertion of a spine label. The binder includes a front panel, a rear panel, and a spine panel. The spine panel has an outer surface having a first raised portion, a second raised portion, and a relatively lower inner portion located between the first and second raised portions. The binder further includes at least one flexible opaque sheet covering the first and second raised portions and the lower inner portion, and a flexible transparent or translucent sheet disposed over at least a portion of the spine panel and at least a portion of the opaque sheet. The transparent sheet and the opaque sheet together defining a spine pocket. The lower inner portion of the spine panel allows a portion of the opaque sheet to deflect inward toward the interior portion and away from the transparent sheet, thereby reducing the amount of force necessary to slide a spine label into the spine pocket. The opaque sheet may be a pigmented vinyl sheet and the transparent sheet may be a transparent plastic sheet, which are all sealed together such as by heat sealing, RF welding, ultrasonic welding, or other techniques, along the lines between the spine panel and the front panel, and between the spine panel and the rear panel, thus forming two plastic flexible hinges for the binder.

The spine may be shaped in any one of a number of ways to produce the relatively raised portions and the relatively depressed portion, including by molding, routing, or stamping. A typical application for the invention would be for use in a ring binder such as a three ring binder although the invention could be used in other applications as well. The spine panel and front and cover panels could be chipboard such as is commonly used in three ring binders. However, other materials such as injection molded plastic or other rigid or semi-rigid materials could be used to make the panels.

In yet another embodiment, the spine panel includes overhanging rails on both longitudinal sides of the panel. These overhanging rails serve to both lift the transparent plastic away from the label sheet and define a slot of predetermined dimensions, independent of the presence or tightness of the transparent plastic, into which a label can be easily inserted. Still another embodiment provides, as a spine panel, a transparent, hard plastic member defining an enclosed slot having an opening only at the top for insertion and removal of a label. This spine creates a neat, professional appearance and protects the appearance of the label over time.

In another aspect the invention is of a binder having a spine construction for easy insertion of a spine label. The binder includes a spine panel including a pair of opposed sidewalls extending outwardly proximate lateral longitudinal edges of the spine panel, a front panel, a rear panel, and a first flexible sheet disposed on an inside surface of the front panel, the rear panel, and the spine panel. The binder also includes a second flexible sheet disposed on an outside surface of the front panel and the rear panel, and disposed on an inside surface of the spine panel. The second sheet is operably attached to the first sheet for encompassing or enclosing the front panel and the rear panel between the first flexible sheet and the second flexible sheet. The binder further includes a third flexible sheet disposed on an outside surface of the spine panel and operably attached to the second flexible sheet for encompassing or enclosing the spine panel between the second flexible sheet and the third flexible sheet. The spine panel has a relatively lower first portion or depression and a relatively raised second portion for holding the third flexible sheet away from the relatively lower first or depressed portion, thus making it easier to insert and remove a spine label.

In a further aspect, the invention is of spine panel that is useable to provide rigidity to the spine of a binder. The spine panel has an inner wall, a first sidewall extending from a longitudinal side of the inner wall, and a second sidewall extending from a longitudinal side of the inner wall opposite the first sidewall. The first sidewall has a first overhang which extends from the first sidewall toward the second sidewall, and is spaced apart from the inner wall. The second sidewall has a second overhang which extends from the second sidewall toward the first overhang, and is spaced apart from the inner wall. The inner wall, first and second sidewalls, and the first and second overhangs together form a slot useable to receive a spine label.

In a still further aspect, the invention is of a binder that includes a front portion, a rear portion, and a spine portion, and a first flexible sheet forming at least a part of each of the three portions. The spine member is disposed on top of the first flexible sheet within the spine portion. A flexible transparent outer sheet is disposed on top of the spine member and in direct contact therewith, and substantially covers each of the three portions. The spine member has a first area that has a lower cross sectional profile than that of a second area, the second area serving to hold the transparent outer sheet away from the first spine area thereby reducing friction between a spine label and the transparent outer sheet as the spine label is being slid into proximity with the first spine area.

In another aspect, the invention is of a binder construction having a front panel, a rear panel, and a spine panel, and a flexible transparent sheet disposed over each of the three panels. The flexible transparent sheet forms at least a part of a first hinge between the front panel and the spine panel, and at least a part of a second hinge between the rear panel and the spine panel. The spine panel has relatively raised longitudinal edges about a central portion, with the raised longitudinal edges holding the transparent sheet in a direction away from the central portion thereby reducing friction as a spine label is slid between the flexible transparent sheet and the spine panel. The spine panel may be bent or bowed, or otherwise have raised outer longitudinal edges, or may be a transparent colored hollow member with a central bore extending substantially therethrough for receiving a spine label.

Exemplary embodiments of the invention will be further described below with reference to the drawings, in which like numbers refer to like parts.

BRIEF DESCRIPTION OF THE DRAWINGS

FIG. 14 is a top cutaway partial fragmentary view of a binder according to a tenth embodiment of the present invention;

FIG. 15 is a perspective view of the spine panel of the binder of FIG. 14; and, FIG. 16 is a top cutaway partial fragmentary view of a binder according to a eleventh embodiment of the present invention.

DETAILED DESCRIPTION OF EXEMPLARY EMBODIMENTS

Figure 1:
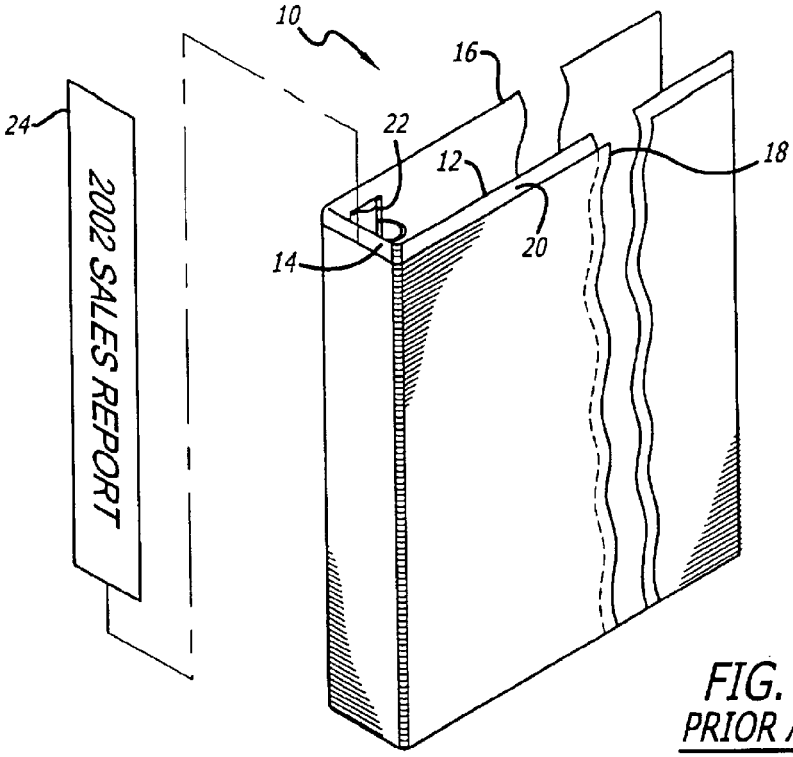
FIG. 1 PRIOR ART
FIG. 1 is a partial fragmentary view of a prior art window binder and a spine label for insertion into the spine window.

FIG. 1 shows a prior art binder of the plastic window binder or view binder variety. The binder 10 includes front cover 12, rear cover 16, and spine cover 14. A flexible transparent sheet 18 such as a clear plastic sheet covers nearly the entirety of the outside of the binder. Typically, there is a small gap between the top of the clear plastic sheet 18 and the top of the panels 12, 14 and 16 to conveniently insert a label into the gaps between those panels and clear plastic sheet 18. Typically, a printed sheet such as a full sized 8½×11 or A4 sheet is slid into the front panel window 20, and a narrower spine label 24 is slid into the spine window. Similarly, a full size sheet can be slid into the rear panel window. The labels for the windows can be paper of standard thickness, or could be card stock or other thicker material. The binder shown includes a three ring binder mechanism 22 for binding individual sheets of paper within binder 10.

Figure 2:
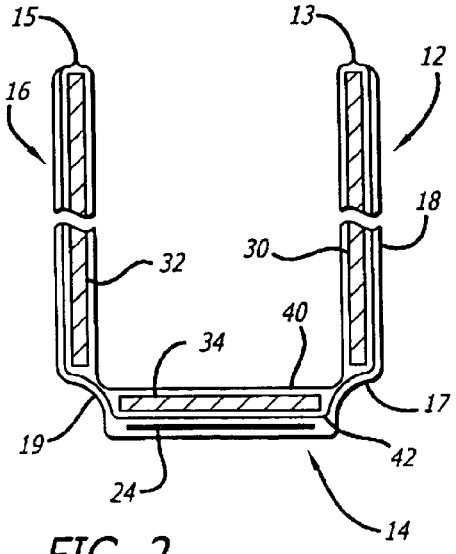
FIG. 2 PRIOR ART
FIG. 2 is a top cutaway partial fragmentary view of the prior art binder of FIG. 1 with the spine label inserted into the spine window.

FIG. 2 is a top cutaway view of the prior art binder of FIG. 1. Front panel 30, rear panel 32, and spine panel 34 are sandwiched between two sheets 40 and 42 of flexible material such as pigmented vinyl or other well-known suitable materials. Clear plastic sheet 18 covers most of the exterior of the binder. The two opaque vinyl sheets 40 and 42 and the clear plastic sheet 18 are sealed together at the ends 13 and 15 of the front and rear covers 12 and 16, respectively, and are further sealed together at points 17 and 19 to form flexible hinges for the binder. The sheets are sealed together by heat sealing, RF welding, thermosonic welding, or other known techniques. Paper spine label 24 is shown inserted into the spine window defined by the gap between outer opaque sheet 42 and clear sheet 18 in the spinal area. The gap between opaque sheet 42 and clear sheet 18 is exaggerated for illustration purposes. Similarly, the gap between opaque sheet 142 and clear sheet 144 in FIG. 3 is exaggerated for illustration purposes.

Figure 3:
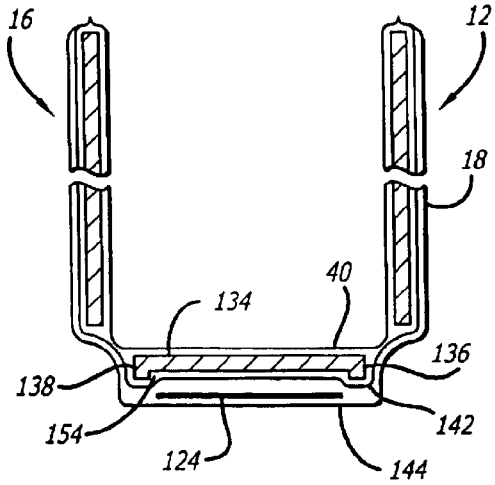
FIG. 3 is a top cutaway partial fragmentary view of a binder constructed according to a first embodiment of the present invention.

FIG. 3 is a top cutaway view of a binder having a depression in its spine for easy insertion of the spine label according to a first embodiment of the present invention. The ring mechanism is omitted for clarity of illustration. The spine panel 134 is altered to create a depression 154. In this embodiment, spine panel 134 is constructed of a generally flat member but having raised rails 136 and 138 along its edges. Flexible opaque sheet 142 therefore can bend inward slightly toward the depression, thus creating a larger gap between flexible opaque sheet 142 and transparent sheet 144 to accommodate spine label 124 and allow it to be slid in and out of the spine window with less friction than in the prior art binder of FIG. 2.

Figure 4:
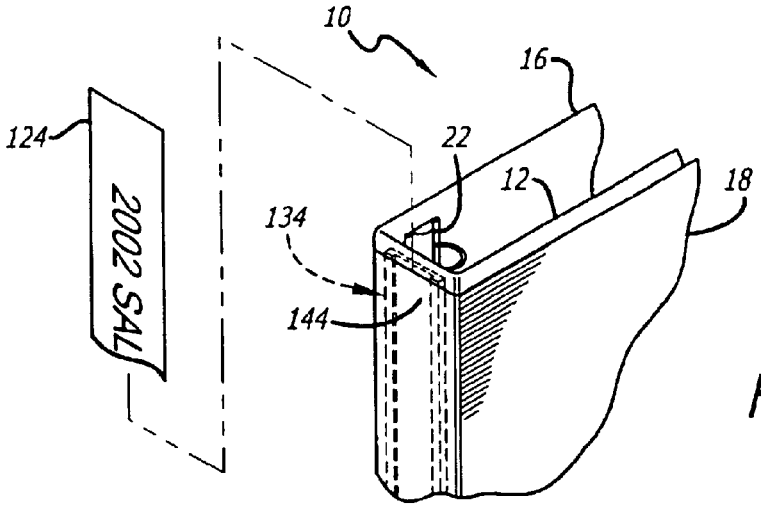
FIG. 4 is a perspective cutaway view of the binder of FIG. 3, with the spine panel member shown in phantom.

FIG. 4 is a perspective view of the binder of FIG. 3, showing the depression 154 in the spine in phantom. The depression in the spine is generally not visible because it is covered by opaque sheet 142.

Figure 5:
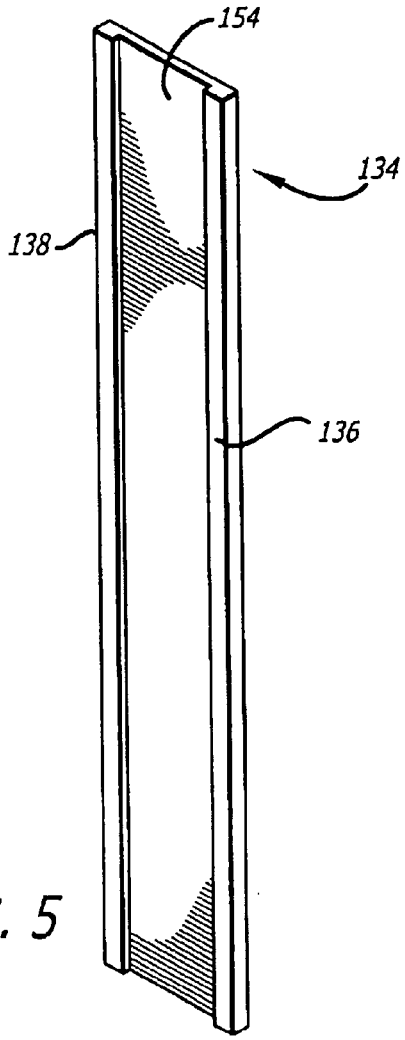
FIG. 5 is a perspective view of the spine panel of the binder of FIG. 4.

FIG. 5 shows just the spine panel 134 of the binder of FIG. 3. Spine panel 134 includes raised rails 136 and 138 along the edges, and depression 154 in the lateral center of the spine member.

Figure 6:
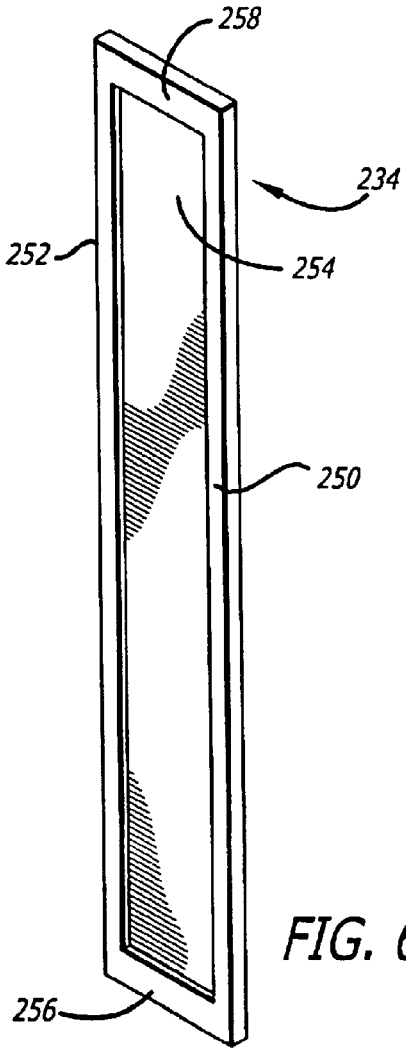
FIG. 6 is a perspective view of a spine panel for a binder according to a second embodiment of the present invention.

FIG. 6 shows a second embodiment of a spine panel according to the present invention. Spine panel 234 includes a relatively depressed area 254 and relatively raised areas along all four sides of the spine panel. This spine panel has raised side rails 250 and 252, and raised top and bottom rails 256 and 258. This embodiment would give the spine greater strength along the tops and bottoms of the spine panel and at the corners of the spine panel, thus allowing the binder to take more punishment such as being dropped on the corners or the top and bottom of the spine while suffering less damage.

Alternatively, the spine panel could have raised rails only along the sides and the bottom. In such a configuration, the spine panel would be as strong along its bottom as the spine panel of FIG. 6, but the binder would allow for as easy insertion of the spine label into the spine window as would a binder that employed the spine panel of FIG. 5. The spine panel shown in FIGS. 5 and 6 could be formed by routing or by molding.

Figure 7:
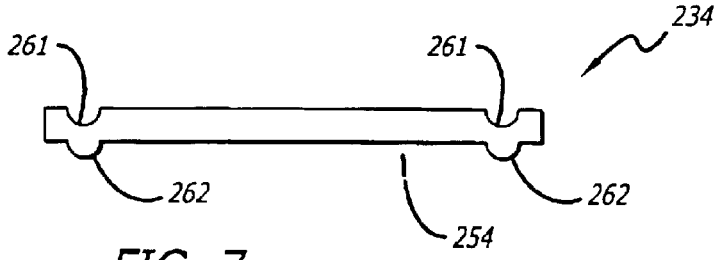
FIG. 7 is a cross sectional view of a spine panel for a binder according to a third embodiment of the present invention.

FIG. 7 shows the cross-section of a spine panel 234 according to another embodiment of the present invention. In this embodiment, spine panel 234 is stamped with a form or otherwise modified near its lengthwise edges so as to create two creases or bumps 262 near the edges, thereby creating depression 254.

Figure 8:
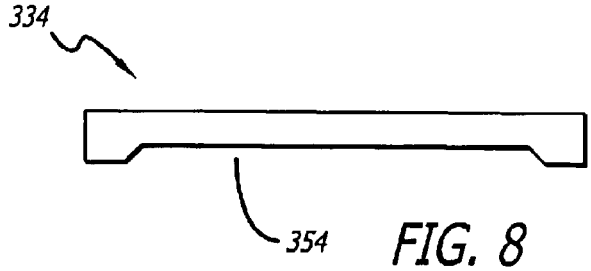
FIG. 8 is a cross sectional view of a spine panel for a binder according to a fourth embodiment of the present invention.

FIG. 8 shows a cross-section of a spine panel according to another embodiment of the present invention. Such a spine panel could be formed by applying a form under sufficient pressure such as by stamping, rolling, or pressing to create a depressed area 354 within spine panel 334.

Figure 9:
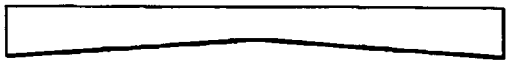
FIG. 9 is a cross sectional view of a spine panel for a binder according to a fifth embodiment of the present invention.

FIG. 9 shows a cross-section of a spine panel according to yet another embodiment of the present invention, in which the outwardly facing surface of the spine panel is angled.

Figure 10:
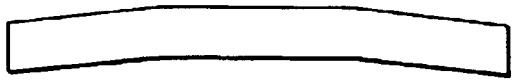
FIG. 10 is a cross sectional view of a spine panel for a binder according to a sixth embodiment of the present invention.

FIG. 10 shows a cross-section of a spine panel according to a further embodiment of the present invention, in which the spine panel has several slightly angled sections.

Figure 11:
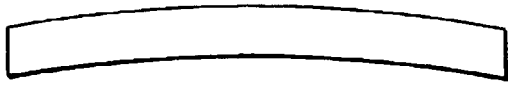
FIG. 11 is a cross sectional view of a spine panel for a binder according to a seventh embodiment of the present invention.

FIG. 11 shows a cross-section of a spine panel according to a still further embodiment of the present invention, in which the outwardly facing surface of the spine panel has a generally concave shape, and the spine panel has a generally uniform cross sectional thickness. The spine panels of FIGS. 10 and 11 might be formed, for example, by beginning with a flat sheet of material and inducing a permanent bend or bends in it, such as by bending under heat and pressure, and optionally adding a stiffening matrix to the material if the material is relatively weak and porous.

Figure 12:
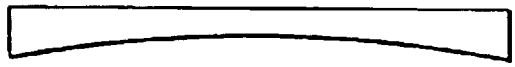
FIG. 12 is a cross sectional view of a spine panel for a binder according to an eighth embodiment of the present invention.

FIG. 12 shows a cross-section of a spine panel according to a still further embodiment of the present invention, in which the outwardly facing surface of the spine panel has a generally concave shape, and the inwardly facing surface of the spine panel is generally flat.

Figure 13:
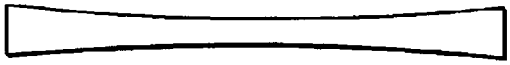
FIG. 13 is a cross sectional view of a spine panel for a binder according to a ninth embodiment of the present invention.

FIG. 13 shows a cross-section of a spine panel according to yet another embodiment of the present invention, in which both the inwardly and outwardly facing surfaces of the spine panel have generally concave shapes.

In all of the illustrative embodiments depicted and described above, the spine panels have relatively raised outer portions and relatively depressed inner portions, such that the opaque plastic sheeting covering the spine panel can deflect inwardly away from the clear plastic window, thus increasing the clearance between the opaque plastic sheet and the clear plastic sheet. This allows a spine label or other identifying indicia to be inserted and removed more easily. In the figures, the thickness of the spine panel is generally exaggerated for illustration purposes.

In FIG. 3, spine label 124 is shown as being narrower than depressed area 154 in spine panel 134. It is not strictly necessary that the spine label be narrower than the depressed area within the spine panel. For example, spine label 124 could extend essentially the entire width of spine panel 134. In such a case, the outer edges of spine label 124 would rest on the raised rails 136 and 138 of spine panel 134 thus creating relatively high friction similar to prior art binders in that limited area. However, the remainder of spine label 124 would have relatively low friction, because the pressure between clear plastic sheet 144 and opaque sheet 142 would be relieved by the depression 154 within spine panel 134. Thus, even if spine label 124 extended substantially the entire width of spine panel 134, spine label 124 could still be inserted within the spine window with significantly lower friction as compared to prior art binders.

FIG. 14 is a top cutaway partial fragmentary view of a binder according to a tenth embodiment of the present invention. The binder includes a spine panel 434 that has raised rails 436 and 438 that run longitudinally along the length of the spine panel 434. At least one, but preferably both, of these raised rails 436 and 438 has an overhang 444 that extends inwardly from the raised rails 436 and 438. These overhangs 444 partly define an open slot 446, into which a spine label 424 may be slid. The overhangs 444 ensure that a covering transparent sheet 418, makes little or no contact with the spine label 424.

As in the aforementioned embodiments and the prior art, the binder of FIG. 14 has a front panel 430 and a rear panel 432 that are held in place by plastic sheets 440 and 442. These sheets are preferably, but not necessarily, opaque. However, it is notable that outer sheet 442 passes behind spine panel 434 rather in front of it, thereby leaving slot 446 open for accepting spine label 424.

FIG. 15 is a perspective view of the spine panel of the binder of FIG. 14 and provides a clear view of slot 446 formed by overhangs 444 of rails 436 and 438. Raised outer portions 436 and 438 have higher cross sectional profiles than that of central portion 448, thus holding helping to hold transparent sheet 418 away from spine label 424 and allowing spine label 424 to slide freely within slot 446 without the substantial friction associated with prior art binders.

FIG. 16 is a top cutaway partial fragmentary view of a binder according to a eleventh embodiment of the present invention. The binder includes a spine panel 534 that is constructed of a substantially transparent plastic and includes an interior slot 546 that is defined between a rear panel wall 548 and a front panel wall 550. The rear panel wall 548 may be opaque but is preferably the same material as the front panel wall 550 for purposes of reducing manufacturing costs. The binder of FIG. 16, like that of FIG. 14, has a front panel 530 and a rear panel 532 that are held in place by a plastic sheets 540 and 542 that are preferably, but not necessarily, opaque. The outer sheet 542 passes behind the spine panel 534 rather in front of it, so that the opaque characteristic of the outer sheet 542 does not interfere with the legibility of the label 524. As with corresponding reference numerals 17, 18 and 19 in FIG. 2, the binder of FIG. 16 includes flexible hinges 517 and 519, and covering transparent sheet 518.

In the embodiments of FIGS. 14–16, the spine label can be made of a colored material such as colored plastic, which results in a colored binder spine. When combined with white opaque plastic sheets 440 and 442, which are popular for view binders, the combination results in an otherwise white view binder with a colored spine. The combination of features is both aesthetically pleasing and is relatively simple and inexpensive to manufacture. The colored rails 438 and 436 in FIG. 14, or the colored outer wall 550 in FIG. 16, give the binder spine even with the spine label 424 or 524 inserted a color that can be viewed when the binder is sitting on a shelf. This allows consumers to use the colors of the binders to help organize binders according to the information contained therein, and readily convey the subject matter of information contained within the binders. Thus, the embodiments of FIGS. 14–16 provide a unique and inexpensive way to construct a view binder while meeting the twin goals of (1) white front and back covers and (2) a colored spine. At the same time, the embodiments also accomplish the additional goal of easy insertion and removal of a spine label. In one variation, the spine 434 of FIG. 14 is permanently affixed to the flexible sheets 440 and 442. In another variation, the spine label may be inserted by the consumer into the pocket defined between outer transparent sheet 418 and the two flexible inner sheets 440 and 442, and held therebetween by tension. In this way, the binder could be sold without a spine, and the consumer can choose which color of spine to purchase and add to the binder. Similarly, spine 534 of the embodiment in FIG. 16 could be either rigidly affixed at the spine to the opaque flexible plastic sheets, or it could be selected by the consumer and inserted into the binder spine pocket by the consumer and held there by tension. In this way, manufacturers, wholesalers, retailers, and consumers can effectively stock a wide variety of differently colored binders while in reality only stocking a variety of differently colored spines. In this variation, the stiff or rigid spine 434 or 534 provides both a removable and changeable coloring for the spine, and can provide substantially all of the structural stiffness of the spine. Whether the spine is rigidly attached to the opaque sheets or not, in the embodiment of FIG. 14 and FIG. 15 the spine will be colored along the lateral edges of the spine and the spine label will be the color of whatever paper is used for the label 424. In the embodiment of FIG. 16 substantially the entire spine panel will be the color of spine 534, with the indicia on spine label 524 showing through transparent colored spine 534.

In each of the embodiments disclosed, the spine member has a first inner portion having a relatively lower profile, and a second outer portion having a relatively higher profile, with the second portion serving to hold the flexible transparent outer sheet away from the first portion, such that a paper spine label can be received within the first portion without substantial friction between the spine label and the transparent outer sheet as the spine label is being inserted or removed.

In addition to making it easier to insert a spine label, another advantage of the improved binder of the present invention is that the binder is more likely to be able to be used a second time, a third time, or more. In prior art view binders, the transparent plastic sheet pressed tightly up against the spine label when the binder was closed. For certain types of printed spine labels such as laser printed spine labels, the transparent plastic sheet being pressed tightly up against the spine label over time tended to make the toner or other ink on the spine label adhere or be infused into the clear plastic sheet. This had the double effect of first making removal of the spine label extremely difficult because it was effectively lightly glued into the spine window, and second even if the spine label were successfully removed, toner or ink from the spine label would transfer to and remain behind on the clear plastic sheet. The resulting ghost image of the old spine label remaining on the spine window partially obscured any new spine label which was inserted into the spine window, and made the binder unsightly and unprofessional looking. Prior art view binders therefore were often simply discarded after they had been used a first time, rather than being refilled with different contents and used a second time.

By contrast, by relieving pressure of the clear plastic sheet on the spine label, the present invention helps to prevent the spine label ink or toner from transferring and therefore sticking to the clear plastic sheet. This not only makes the spine label significantly easier to remove especially after the spine label has been inserted for a long period of time, but increases the likelihood that the spine label will be able to be successfully removed without leaving a ghost image of the first label behind. This increases the likelihood that the binder will be used a second time, a third time, or more times, thus effectively increasing the average useful life of the binder and making it more environmentally friendly.

It will be appreciated that the term "present invention" as used herein should not be construed to mean that only a single invention having a single essential element or group of elements is presented. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the panel members could be made of various materials and formed according to various methods including but not limited to stamping, rolling, bending, routing, and injection molding; the flexible sheets could be made of various materials; and the flexible sheets could be sealed together according to various methods. A three ring binder mechanism could be affixed to the rear cover panel as shown in FIG. 4 and as is commonly practiced, but could also be affixed to the spine as is also commonly practiced. The binder need not be a three ring binder, and need not be designed for holding only paper but could be used to display and hold other objects such as cassette tapes, product samples, and other objects. In a product holder, the cassette tapes or other products could be held within shaped recesses on the insides of the front and rear covers. The binder need not be formed of three panels only, but could be a folding mechanism having virtually any number of panels. Thus, it will be understood that the term "binder" as used herein need not refer to a paper binder, but refers more generally to any multi-paneled folding mechanism having a window through which identifying indicia may be viewed. It will be also understood that the word "opaque" as used herein need not mean completely absorbing of light, but includes sheets that absorb enough of the light so as to be suitable for use as binder panel covers. Similarly, the word "transparent" as used herein need not mean transmitting one hundred percent of the light without visual distortion within particular frequencies, but can mean transmitting most of the light with a small enough amount of visual distortion such that identifying indicia underneath remains sufficiently legible for labeling purposes. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A binder having a spine construction for easy insertion of a spine label, comprising:

a spine panel having an inside surface, an outside surface and a pair of opposed sidewalls extending outwardly proximate lateral longitudinal edges of the spine panel;

a front panel having an inside surface and an outside surface;

a rear panel having an inside surface and an outside surface;

a first flexible sheet located on the inside surfaces of the front panel, the rear panel, and the spine panel;

a second flexible sheet located on the outside surfaces of the front panel and the rear panel, and located on the inside surface of the spine panel, the second sheet operably attached to the first sheet for enclosing the front panel and the rear panel between the first flexible sheet and the second flexible sheet;

a third flexible sheet located on the outside surface of the spine panel and operably attached to the second flexible sheet for encompassing the spine panel between the second flexible sheet and the third flexible sheet;

the binder having an opening sized to accept the spine label; and wherein the spine panel has a depression and a raised portion to create a cavity to receive the spine panel, the flexible sheet being located away from the depression to reduce resistance to movement of the spine label.

2. The binder according to claim 1 wherein at least one of the sidewalls includes an overhang extending toward the opposite rail and displaced from the spine panel, thereby defining the opening, the opening being located between the overhang and the spine panel.

3. The binder according to claim 1 wherein the spine panel includes a transparent outer wall that defines a slot for receiving a label.

4. The binder according to claim 1 wherein the second flexible sheet is opaque.

5. The binder according to claim 1 wherein the third flexible sheet is transparent.

6. The binder according to claim 1 wherein the third flexible sheet is further disposed on an outside surface of the front panel and the rear panel such that the second flexible sheet is disposed between the outside surface of the front and rear panels, and the third flexible sheet.

7. The binder according to claim 1 wherein the first and second flexible sheet are configured to form a first hinge between the front panel and the spine panel, and to form a second hinge between the rear panel and the spine panel.

8. A spine panel, useable to provide rigidity to the spine of a binder, comprising:

an inner wall;

a first sidewall extending from a longitudinal side of the inner wall;

a second sidewall extending from a longitudinal side of the inner wall opposite the first sidewall;

a first overhang extending from the first sidewall toward the second sidewall, the first overhang spaced apart from the inner wall;

a second overhang extending from the second sidewall toward the first overhang, the second overhang spaced apart from the inner wall;

wherein the inner wall, first and second sidewalls, and the first and second overhangs together form a slot useable to receive a spine label.

9. The spine panel according to claim 8 wherein the first overhang is spaced apart from the second overhang.

10. The spine panel according to claim 8 wherein the inner wall comprises plastic.

11. The spine panel according to claim 8 wherein the first overhang extends to meet the second overhang and is unitary therewith, such that the first and second overhangs form a transparent outer wall opposite the inner wall and spaced apart therefrom, with a spine label viewable through the transparent outer wall.

12. The binder according to claim 8 wherein the outer wall, inner wall, and sidewalls comprise transparent plastic.

13. A binder construction comprising:

a front portion, a rear portion, and a spine portion, and a first flexible sheet forming at least a part of each of the three portions;

a spine member disposed on top of the first flexible sheet within the spine portion;

a flexible transparent outer sheet disposed on top of the spine member and in direct contact therewith, and substantially covering each of the three portions;

the spine member having a first area that has a lower profile than that of a second area, the second area serving to hold the transparent outer sheet away from the first spine area thereby reducing friction between a spine label and the transparent outer sheet as the spine label is being slid into proximity with the first spine area.

14. A binder construction according to claim 13 wherein the spine member is colored.

15. A binder construction according to claim 14 wherein the first flexible sheet is white in color.

16. A binder construction according to claim 13 wherein the spine portion has a structural stiffness and the spine member provides substantially all of the structural stiffness of the spine portion.

17. A binder construction according to claim 13 wherein the spine member is not affixed within the spine portion and is removable.

18. A binder construction according to claim 13 wherein the spine member is not affixed within the spine portion and is colored and removable, such that a person can change the color of at least a part of the spine portion of the binder by changing spine members.

19. A binder construction for receiving a spine label, comprising:

a front panel, a rear panel, and a spine panel;

a flexible transparent sheet disposed over each of the three panels and forming at least a part of a first hinge between the front panel and the spine panel, and at least a part of a second hinge between the rear panel and the spine panel;

wherein the spine panel has relatively raised longitudinal edges about a central depression, the raised longitudinal edges holding the transparent sheet in a direction away from the central depression thereby reducing resistance as a spine label is moved between the flexible transparent sheet and the spine panel.

20. The binder construction of claim 19 wherein the flexible transparent sheet is additionally configured for holding a front cover label between the flexible transparent sheet and the front panel.

* * * * *